US005317966A

United States Patent [19]

Hackelborger

[11] Patent Number: 5,317,966

[45] Date of Patent: Jun. 7, 1994

[54] DAMPING ROLLER FOR A PRINTING PRESS

[75] Inventor: Gerhard Hackelborger, Offenbach am Main, Fed. Rep. of Germany

[73] Assignee: MAN Roland Druckmaschinen AG, Fed. Rep. of Germany

[21] Appl. No.: 926,928

[22] Filed: Aug. 7, 1992

[30] Foreign Application Priority Data

Aug. 8, 1991 [DE] Fed. Rep. of Germany ..... 4126142

[51] Int. Cl.[5] ..... B41L 25/00

[52] U.S. Cl. ..... 101/147; 101/148

[58] Field of Search ..... 101/147, 148, 475, 407.1; 492/47

[56] References Cited

U.S. PATENT DOCUMENTS

| | | | |
|---|---|---|---|
| 1,804,139 | 1/1926 | Adsit et al. | 101/475 |
| 2,007,588 | 9/1932 | Wescott | 101/148 |
| 2,181,136 | 11/1939 | Knox | 492/47 |
| 2,671,262 | 12/1950 | Kuniholm | 492/47 |
| 3,467,009 | 9/1969 | Ross | 101/407.1 |
| 3,646,652 | 3/1972 | Heiligenthal et al. | 492/53 |
| 3,986,452 | 10/1976 | Dahlgren | 101/148 |
| 3,990,391 | 11/1976 | Singh | 492/47 |
| 4,009,658 | 3/1977 | Heurich | 101/348 |
| 4,925,014 | 5/1990 | Haite | 193/37 |
| 4,932,319 | 6/1990 | Switall | 101/147 |

FOREIGN PATENT DOCUMENTS

| | | |
|---|---|---|
| 0293551A2 | 2/1988 | European Pat. Off. . |
| 0400621A2 | 5/1990 | European Pat. Off. . |
| 580963 | 7/1933 | Fed. Rep. of Germany . |
| 3339724A1 | 7/1984 | Fed. Rep. of Germany . |
| 2607255C2 | 7/1985 | Fed. Rep. of Germany . |
| 362424 | 7/1962 | Switzerland . |

*Primary Examiner*—Edgar S. Burr
*Assistant Examiner*—Anthony H. Nguyen
*Attorney, Agent, or Firm*—Leydig, Voit & Mayer, Ltd.

[57] ABSTRACT

A damping roller for the damping unit in a printing press has a roller body that carries a glass, glass ceramic, or enamel outer material, layer, or coating. Suitable coatings can be produced, for example, by enamelling, plasma spraying, or attaching the outer layer to the body with a sealing compound. In another embodiment, the glass, glass ceramic, or enamel material acts as the self-supporting roller member accommodated solely by the journals. Preferably, the outer surface of the roller is polished. The damping roller of the invention has the ability to dispense an optimum amount of damping medium while eliminating or reducing damping medium additives such as alcohol to less than 6% of the total mixture.

5 Claims, 1 Drawing Sheet

DAMPING ROLLER FOR A PRINTING PRESS

FIELD OF THE INVENTION

The present invention relates generally to a damping roller for use in a printing press damping unit. More particularly, this invention relates to an improved damping roller which can provide an increase in the amount of damping medium applied by the roller without the need to combine costly additives such as alcohol to the damping medium.

BACKGROUND OF THE INVENTION

The general purpose of a damping roller within a damping unit of a printing press is to apply a damping medium to some preselected surface, such as a printing plate carried on a rotating plate cylinder. To this end, it is desirable to have a damping roller with an optimum amount of "wettability." A damping roller which is wettable can receive and apply the damping medium. A damping roller with comparatively increased wettability denotes that this particular damping roller can receive comparatively increased quantities of damping medium. On the other hand, a decrease in roller wettability results not only in a decrease in the damping medium application rate but also often results in a non-uniform application of the damping medium. Without an optimum damping medium application rate, the printing process yields ink variations and associated printing problems. It is essential to a successful printing process to maintain a steady damping application rate.

Intimately related to the wettability and the damping medium application rate of a particular damping roller is the damping roller's surface material. A large variety of materials, coverings, or surface structures are known for damping rollers. Damping units traditionally have rollers made of steel, rubber, or textile coverings. Other damping roller surfaces are made of material permeable to a liquid such as porcelain or fired clay (DE-PS 580 963). Prior art damping roller coverings have also been made of elastic yarn (DE-PS 2 607 255) or plastic fibers embedded in resin (EP 0 293 551). Yet another patent (EP 0 400 621) discloses a damping roller whose shell is coated with ceramic/metal carbides. In some cases, these roller surfaces can become "wettable" only if hydrophilic agents, such as gum arabic, are applied to the damping roller surface.

The main disadvantage of these damping rollers is that alcohol or another suitable agent must be added to the damping medium to increase the roller's wettability. If the alcohol is eliminated or if the ratio of the alcohol to the total mixture is reduced to less than 6%, the wettability of these rollers significantly decreases. In contrast, however, damping media that contain less than 6% alcohol in the total damping mixture are considered optimum in the printing business. Hence, a need exists for a damping roller which uses a low damping medium additive concentration while still maintaining a high wettability.

OBJECTS AND SUMMARY OF THE INVENTION

Accordingly, it is the object of the invention to provide a damping roller whose outer surface will provide an optimum degree of wettability when the total damping medium mixture is less than 6% alcohol or other wettability enhancing additive.

In accordance with the present invention, the above object is realized by providing an outer layer of glass, glass ceramic, or enamel disposed concentrically on a roller base or body. These layers may be applied onto the roller body through the use of a sealing compound or plasma process. Furthermore, the invention also contemplates that a roller base body may be eliminated and that the damping roller would consist entirely of the glass, glass ceramic or enamel material.

Pursuant to another aspect of the invention and after the outer material is affixed to the roller shell, a polishing operation is performed. The polished mantle surface brings about a high wettability for the damping media without requiring additional operations such as adding alcohol to the damping media. In comparison to conventionally smooth surfaces it has been found that with the execution according to the present invention, the damping medium applied off of the polished surface remains constant for a substantially longer time.

Another advantage of the damping roller of the present invention is that there is no need for the otherwise conventional treatment of the roller surface with hydrophilic agents. The steady damping medium application rate of the present invention results in a uniform film of damping medium on the printing plate. Moreover, ink variation and register difficulties are reduced and the addition to the damping medium of alcohol, which is harmful to health and the environment, is reduced to an unobjectionable degree or is completely eliminated.

These and other features and advantages of the invention will be more readily apparent upon reading the following description of a preferred exemplified embodiment of the invention and upon reference to the accompanying drawings.

While the invention will be described and disclosed in connection with certain preferred embodiments and procedures, it is not intended to limit the invention to those specific embodiments. Rather it is intended to cover all such alternative embodiments and modifications as fall within the spirit and scope of the invention.

DETAILED DESCRIPTION OF THE PREFERRED EMBODIMENT

Figure 1:
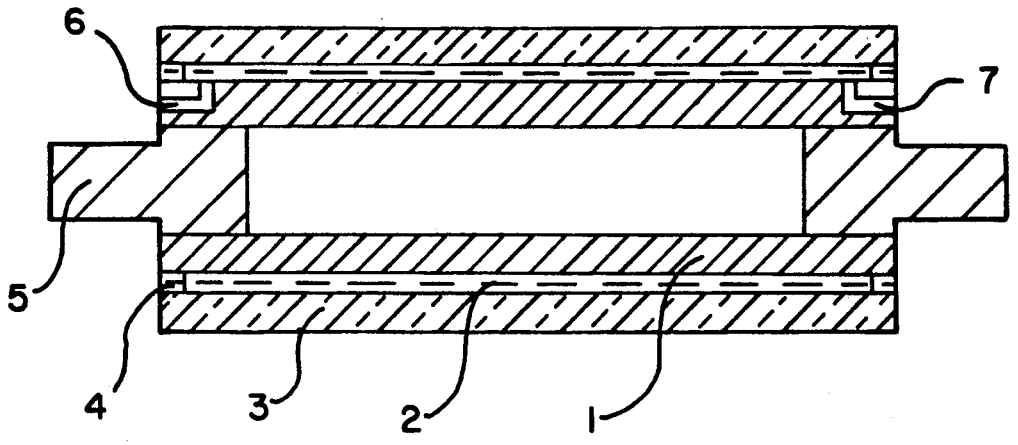
FIG. 1 is a cross sectional view of a damping roller of the present invention having a glass coating attached thereon.

Turning now to the drawings, a cross section of a damping or moistening roller for a printing press is shown in FIG. 1. A glass layer 3 is applied concentrically to a roller body 1 carried by two journals 5; the two parts 1 and 3 being stuck together by means of a sealing compound 2. Sealing rings 4 are disposed at the ends of the body and also act as centering rings for the outer layer.

As shown in the embodiment of FIG. 1, there is a small gap between the glass layer 3 which, in the present example, is in the form of a glass tube, and the roller body 1. The sealing compound 2 is introduced into this gap through an entry aperture 6 in the shell 1, in conjunction with the venting bore 7. The sealing rings 4 at the roller body ends center the glass tube relative to the roller shell and simultaneously seal off the gap. When the sealing compound 2 has set, the outer surface of the glass coating 3 is polished.

Figure 2:
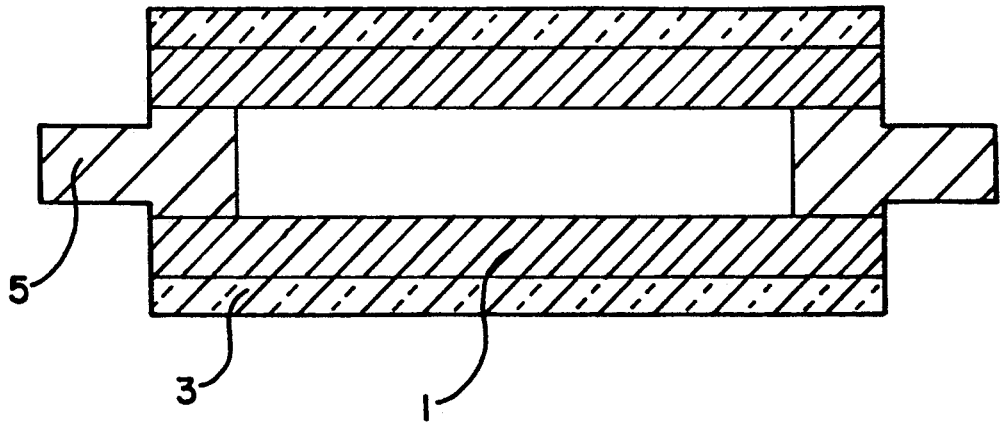
FIG. 2 is a cross sectional view of an alternative damping roller having a glass ceramic coating sprayed thereon.

In FIG. 2, an alternative damping roller is shown. Here, a glass layer or ceramic coating 3 is applied directly to the shell 1. Preferably, this is done by spraying it on by means of a gas plasma process or the like. The outer surface of the glass ceramic coating 3 is then also polished.

Another construction of a damping roller can be obtained by eliminating the roller body 1, the journals 5 themselves directly carrying the appropriately dimensioned glass or glass ceramic material 3. In addition, reinforcing material, such as wire gauze or fiber glass, may additionally be introduced into the glass or glass ceramic coating 3 to increase stability and prevent fracturing thereof.

I claim as my invention:

1. A damping roller comprising, in combination, a cylindrical roller body and means for transferring a damping medium containing less than 6% alcohol or other wettability enhancing additives from the damping unit in a printing press, said means including a concentric outer layer of material selected from the group consisting of glass, glass ceramic and enamel attached to said roller body, said outer layer having a smoothly polished outer surface clean and free of hydrophilic agents such as gum arabic, and said material of said outer layer and said polished and clean outer surface thereof combining to provide optimum wettability of said roller to damping medium containing less than 6% alcohol or other wettability enhancing additives.

2. A damping roller as defined in claim 1 wherein said outer material layer is in the form of a glass tube attached to said roller body by means of a sealing compound.

3. A damping roller as defined in claim 2 wherein said glass tube is mounted on said roller body and is disposed with an annular gap located between said roller body and said glass tube, means including an entry aperture formed in said roller body and communicating with said annular gap for the introduction of said sealing compound therein, and said roller also including a pair of sealing rings at opposite ends of said roller body for sealing said entry aperture.

4. A damping roller according to claim 1 wherein said outer material layer is formed of enamel and is attached to said roller body by melting or spraying said enamel onto the surface of said roller body.

5. A damping roller as defined in claim 1 wherein said roller including said roller body is made entirely of material selected from the group consisting of glass, glass ceramic and enamel.

* * * * *